US007418771B2

(12) United States Patent
Hori

(10) Patent No.: US 7,418,771 B2
(45) Date of Patent: Sep. 2, 2008

(54) CLIP FOR CLAMPING CLOTH FOR USE WITH EMBROIDERY FRAME

(75) Inventor: Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 256 days.

(21) Appl. No.: 11/078,295

(22) Filed: Mar. 14, 2005

(65) Prior Publication Data

US 2005/0229366 A1 Oct. 20, 2005

(30) Foreign Application Priority Data

Mar. 31, 2004 (JP) ..... 2004-103087

(51) Int. Cl.
*D05C 1/04* (2006.01)

(52) U.S. Cl. ..... 24/530; 24/459; 24/555; 112/103; 112/258; 38/102.2; 38/102.91

(58) Field of Classification Search ..... 112/103, 112/258, 80.3; 38/102.2, 102.91; 40/603; 160/380; 24/459–462, 530, 555, 563
See application file for complete search history.

(56) References Cited

U.S. PATENT DOCUMENTS 517,860 A * 4/1894 Hooper ..... 38/102.2
1,248,783 A * 12/1917 Andrews ..... 38/102.2
2,153,122 A * 4/1939 Powell ..... 229/5.7
3,823,967 A * 7/1974 Knize ..... 292/258
4,194,312 A * 3/1980 Connors et al. ..... 38/102.5
4,333,599 A * 6/1982 Stemen ..... 229/5.7
(Continued)

FOREIGN PATENT DOCUMENTS

JP A 52-25863 8/1950
(Continued)

*Primary Examiner*—James R Brittain
(74) *Attorney, Agent, or Firm*—Oliff & Berridge, PLC

(57) ABSTRACT

A clip for clamping a cloth according to the invention is mounted on an embroidery frame including an outer frame, and an inner frame which is internally engaged with the outer frame thereby to hold a cloth to be worked between the outer frame and the inner frame. The clip includes a leaf spring member which can be detachably mounted on the outer frame, and an urging member which is fitted to this leaf spring member and adapted to press the cloth to be worked onto the inner frame. The leaf spring member has a first engaging portion adapted to be engaged with a lower part of the outer frame from outside, a first plate portion extending upwardly from the first engaging portion, a second plate portion formed in an upper part of this first plate portion by way of a bent portion and downwardly inclined along an inner face of the outer frame, and a second engaging portion formed in this second plate portion and adapted to be engaged with an upper part of the outer frame from inside. The urging member is provided on the second plate portion and adapted to press a part of the cloth to be worked extending upwardly from between the outer frame and inner frame onto the inner frame. According to the structure, the cloth to be worked can be reliably clamped to be held in a stabilized state, and a slack of the cloth while embroidering can be prevented. At the same time, the clip can be made compact and lightweight, and can be easily mounted or dismounted.

17 Claims, 11 Drawing Sheets

U.S. PATENT DOCUMENTS 4,991,329 A * 2/1991 Wilson ..... 40/732
5,232,116 A * 8/1993 Baxter ..... 220/324
5,309,332 A * 5/1994 Evans et al. ..... 362/97
5,388,283 A * 2/1995 Garnett ..... 4/503
5,913,496 A * 6/1999 Valdez ..... 248/99
6,971,146 B2 * 12/2005 Gessner et al. ..... 24/295
2003/0074815 A1 * 4/2003 Tajima et al. ..... 38/102.2

FOREIGN PATENT DOCUMENTS

JP A-6-101155 4/1994
JP A-11-61627 3/1999
JP 2002085876 A * 3/2002
JP 2003144783 A * 5/2003

* cited by examiner

CLIP FOR CLAMPING CLOTH FOR USE WITH EMBROIDERY FRAME

BACKGROUND OF THE INVENTION

1. Field of the Invention

The present invention relates to a clip for clamping a cloth to be mounted on an embroidery frame which is used for conducting embroidery sewing on an embroidering machine, and more particularly, to the clip for clamping the cloth which is intended to increase a stretching and holding force with respect to a cloth to be worked which has been held on the embroidery frame in a stretched manner.

2. Description of the Related Art

As an example of an embroidery frame for holding a cloth to be worked in a stretched manner on occasion of conducting embroidery sewing on an embroidering machine, a structure which includes, for example, an outer frame having a pair of clamping mechanisms and an inner frame to be fitted to an inside of this outer frame has been known. The above described outer frame and inner frame are formed in a rectangular shape, respectively having corner parts and straight parts.

In case of setting the cloth to be worked on the embroidery frame having such a structure, the cloth to be worked is first placed on the outer frame, and in this state, the inner frame is fitted to the inside of the outer frame, thereby to hold the cloth to be worked between the outer frame and the inner frame. Then, by pulling a part of the cloth projecting from the embroidery frame, the cloth to be worked will be set in a stretched manner. In this state, screw members which are constituent elements of the aforesaid clamping mechanisms provided on the outer frame are rotated to tighten the clamping mechanisms, thereby to clamp the outer frame onto the inner frame.

By the way, the embroidery frame of this type has had the following problem. Specifically, even though the outer frame is clamped onto the inner frame by means of the clamping mechanisms, the straight parts of the outer frame is not able to be sufficiently clamped onto the straight parts of the inner frame, because the respective straight parts of the outer frame and the inner frame have long lengths. Therefore, in case of conducting embroidery sewing for example on a thin cloth, particularly the straight parts of the frames cannot be sufficiently clamped. In such a case, it sometimes happens that a part of the cloth to be worked which has been held between the straight parts of the outer frame and the inner frame might be withdrawn toward the inner frame by tension of a thread for embroidery sewing, and this part of the cloth might be slackened. Consequently, an embroidery pattern may become smaller than desired, and contorted, or wrinkles may occur around the embroidery pattern, resulting in a poor outer appearance.

As a countermeasure against such problem, the following arts are disclosed in Japanese Utility Model Publication No. JU-A-52-25863. An art as shown in FIGS. 1 to 4 of the above mentioned publication (hereinafter referred to as a first art) has such a structure that a clip made of a leaf spring is fitted to an outside face of an inner frame on which a cloth to be worked has been placed, and after both upper and lower faces of the cloth to be worked together with the inner frame are clamped with the clip, the inner frame is fitted inside the outer frame. Moreover, an art as shown in FIGS. 5 to 8 of the publication (hereinafter referred to as a second art) has such a structure that an inwardly protruding flat plate is formed along an inner periphery of a frame body, and an engaging pipe of a frame shape is fixedly provided on the flat plate. In this state, a plurality of locking clips each having a substantially hexagonal sectional shape are fitted to the engaging pipe, thereby to clamp the cloth to be worked along an entire circumference of the engaging pipe so as to hold the cloth in a stretched state.

However, according to the above described first art, although the clip can clamp the cloth to be worked onto the inner frame, the clip is simply engaged with the outer frame in a manner just placed inside the outer frame. Accordingly, there has been such anxiety that the clip which is clamping the cloth to be worked may be displaced with vibrations or so, on occasion of conducting the embroidery sewing, and the cloth may become slackened. In order to correct the slack, the inner frame together with the clip must be dismounted from the outer frame, but it is not easy to mount or dismount the clip. Moreover, according to the above described second art, because the engaging pipe is provided on the flat plate of the frame body, the frame body becomes inevitably larger in width, and therefore, a range to be embroidered will be decreased. Further, in order to obtain a sufficient stretching and holding force of the locking clip, it is necessary to make both a diameter of the engaging pipe and a diameter of the locking clip larger, and consequently, the engaging pipe will undesirably protrude upwardly. For this reason, this locking clip cannot be applied to a sewing machine intended for home use in which a space above the sewing machine cannot be sufficiently secured on occasion of conducting the embroidery sewing.

SUMMARY OF THE INVENTION

An object of the invention is to provide a clip for clamping a cloth which is compact and lightweight, and can be easily mounted or dismounted, and with which a reliable stretching and holding force can be obtained, and a sufficient range of embroidery sewing can be ensured.

The present invention provides a clip for clamping a cloth to be mounted on an embroidery frame including an outer frame and an inner frame which is internally engaged with the outer frame thereby to hold the cloth to be worked between the outer frame and the inner frame, the clip comprising; a leaf spring member which can be detachably mounted on the outer frame, and an urging member which is fitted to this leaf spring member and adapted to press the cloth to be worked onto the inner frame, wherein the leaf spring member has a first engaging portion adapted to be engaged with a lower part of the outer frame from outside, a first plate portion extending upwardly from the first engaging portion, a second plate portion formed in an upper part of this first plate portion by way of a bent portion and downwardly inclined along an inner face of the outer frame, and a second engaging portion formed in this second plate portion and adapted to be engaged with an upper part of the outer frame from inside, the urging member being provided on the second plate portion and adapted to press a part of the cloth to be worked extending upwardly from between the outer frame and inner frame onto the inner frame.

According to such structure, because the leaf spring member is provided with the urging member for pressing a part of the cloth to be worked extending upwardly from between the outer frame and the inner frame, it is possible to reliably clamp the cloth to be worked by means of the clip for clamping the cloth, keeping the cloth in a stably held state, and to prevent a slack of the cloth to be worked on occasion of embroidery sewing.

Moreover, the first engaging portion and the second engaging portion of the leaf spring member are so designed as to be engaged with the outer frame, on occasion of mounting the clip for clamping the cloth on the embroidery frame. Accordingly, the clip can be made compact and lightweight, provided that the clip has such a size as can be mounted on the outer frame, and therefore, the clip can be produced at low cost and can be also applied to an embroidery frame of a sewing machine for home use. Because the clip for clamping the cloth is intended for use mounted on the outer frame, the clip will not project into the inner frame, and will not decrease the range of the embroidery sewing. Also, in case of stretching again the cloth to be worked, the clip can be easily mounted or dismounted.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Now, a first embodiment of the invention will be described referring to FIGS. 1 to 8.

Figure 1:
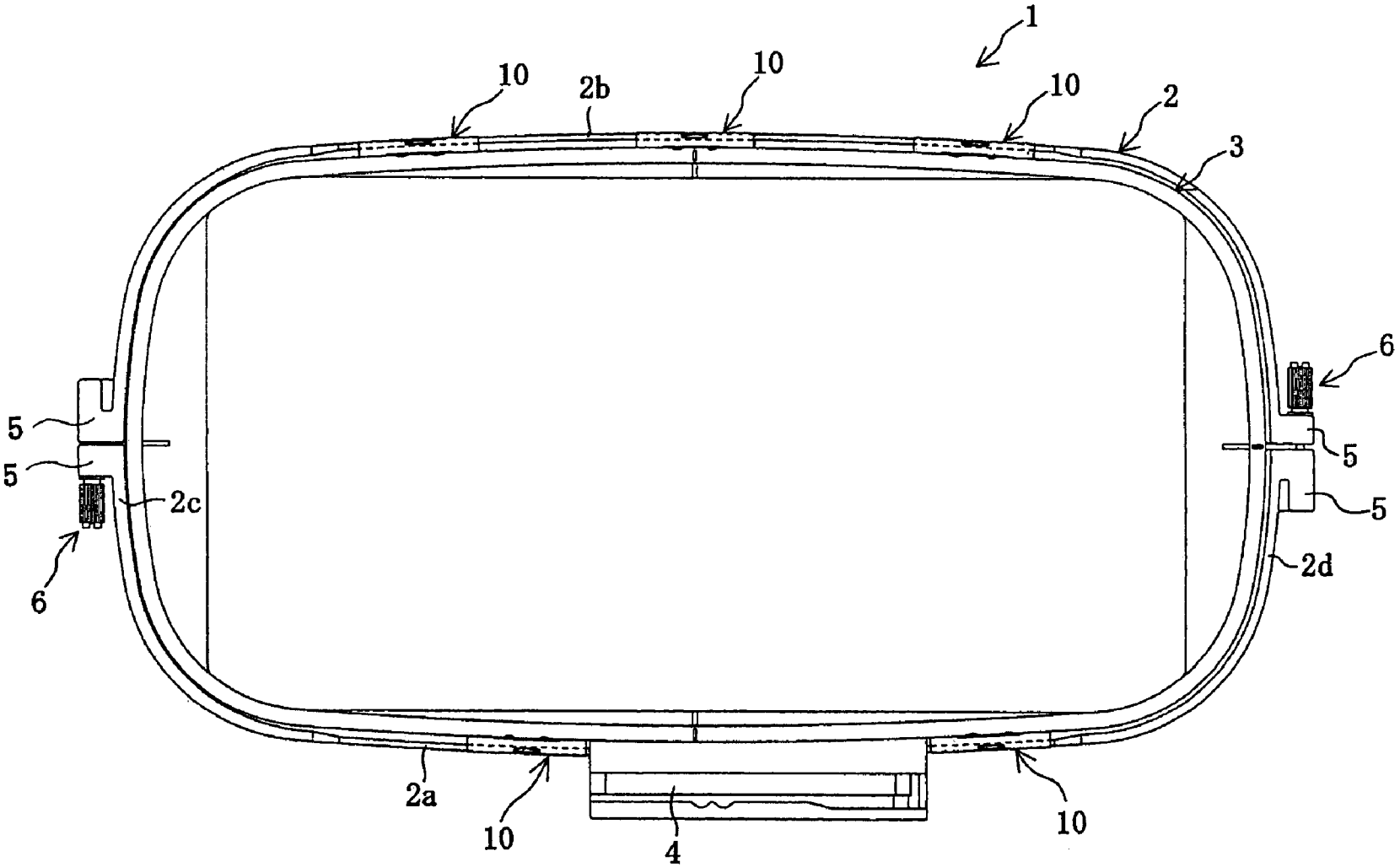
FIG. 1 is a plan view of an embroidery frame showing a first embodiment of the invention.

As shown in FIG. 1, an embroidery frame 1 has a substantially rectangular shape in a plan view, and includes an outer frame 2 and an inner frame 3. The outer frame 2 has four sides 2*a* to 2*d* in a substantially straight line, and its corner parts are rounded. The longer side 2*a* of the outer frame is provided with a fitting part 4 which is connected to a driving force outlet (not shown) of an embroidery frame moving mechanism (not shown) of an embroidering machine (not shown). A pair of the shorter sides 2*c*, 2*d* of the outer frame are respectively provided with clamped parts 5 which are divided at respective centers in a longitudinal direction thereof. Further, the sides 2*c*, 2*d* are respectively provided with clamping mechanisms 6 which are so constructed as to clamp the outer frame 2 onto the inner frame 3 by tightening the aforesaid clamped part 5.

The outer frame side 2*b* on an opposite side to the fitting part 4 is provided with three clips 10 for clamping the cloth at regular intervals, and the outer frame side 2*a* having the fitting part 4 is also provided with two clips 10 for clamping the cloth.

Then, the clip 10 for clamping the cloth will be described referring to FIGS. 2 to 8.

Figure 6:
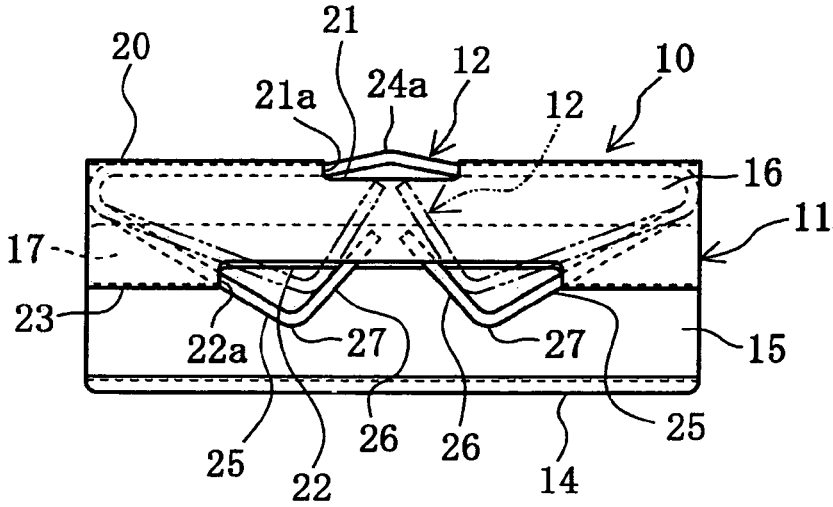
FIG. 6 is a front view of a clip for clamping a cloth.

As shown in FIG. 6, the clip 10 for clamping the cloth has a leaf spring member 11 (corresponding also to a mounting member) which is detachably mounted on the outer frame 2 (See FIG. 1), and a spring member 12 for pressing a part of a cloth F to be worked (See FIG. 8) extending upwardly from between the outer frame 2 and the inner frame 3 onto the inner frame 3. The leaf spring member 11 is formed of a thin plate made of metal, for example.

Figure 3:
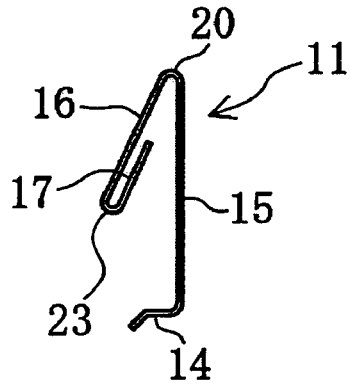
FIG. 3 is a side view of the leaf spring member.

The leaf spring member 11 integrally has, as shown in FIG. 3 showing a side view of the same, a first engaging portion 14 (corresponding also to a locking portion), a first plate portion 15 (corresponding also to a contact portion), a second plate portion 16, and a second engaging portion 17 which is formed in parallel with the second plate portion 16 by way of a second bent portion 23.

The first engaging portion 14 is formed horizontally in a lower part of the leaf spring member 11, and adapted to be engaged with a lower part of the outer frame 2 from outside. In a state where the clip 10 for clamping the cloth has been mounted on the embroidery frame 1, the first engaging portion 14 is engaged with an engaging recess 18 which has been formed in the lower part of the outer frame 2, and locked to the engaging recess 18 so as not to protrude from a lower end face of the outer frame 2 (in a not protruded state).

Figure 8:
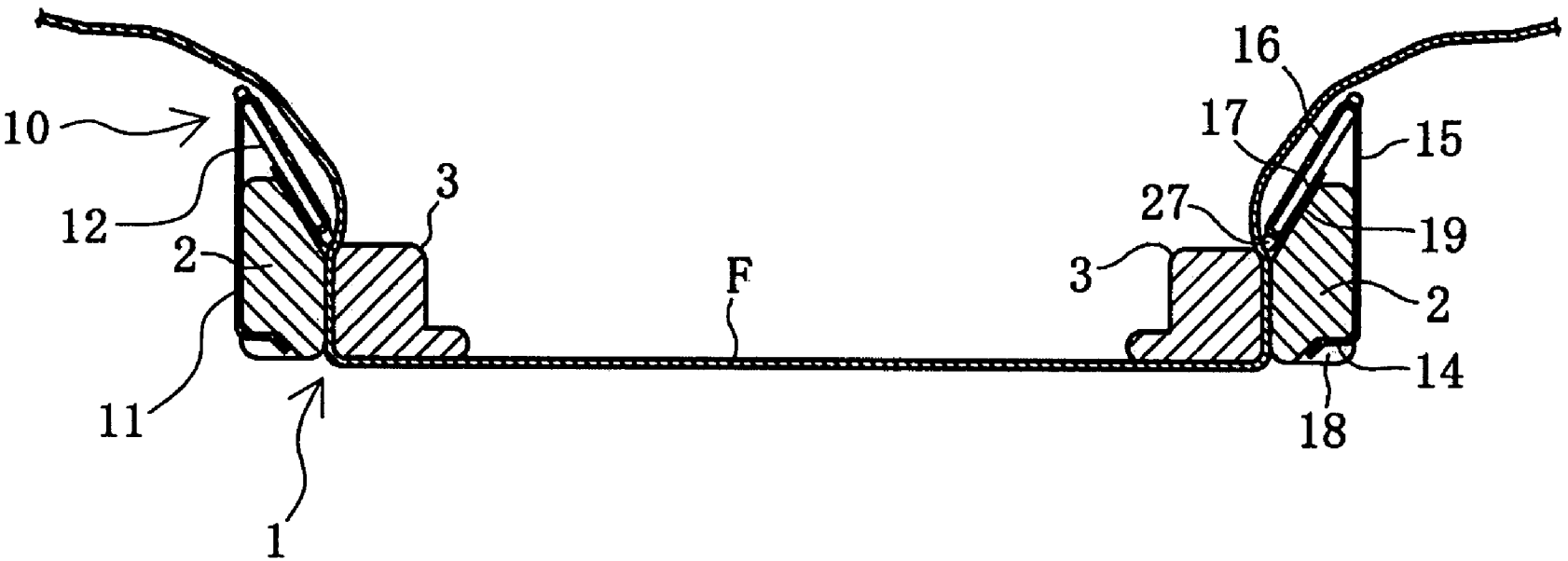
FIG. 8 is a sectional view of the embroidery frame in a state where a cloth to be worked is held on the embroidery frame with the clip for clamping the cloth.

The first plate portion 15 extends upwardly in a vertical direction from the first engaging portion 14 so as to protrude upward from an upper end of the outer frame 2, as shown in FIG. 8. A height of the first plate portion 15 is about 1.5 times of a height of the outer frame 2. An inner face of the outer frame 2 in an upper half thereof is formed as an inclined face 19 which is inclined down inwardly (inclined at an acute angle of about 30 degree with respect to a vertical plane).

The second plate portion 16 is formed so as to be downwardly inclined from a first bent portion 20 in an upper part of the first plate portion 15, in parallel with the inclined face 19 of the outer frame 2. The second engaging portion 17 is formed so as to extend in parallel with the aforesaid second plate portion 16 by way of the second bent portion 23 which is bent inwardly from a lower part of the second plate portion, up to a half length of this second plate portion 16.

Figure 2:
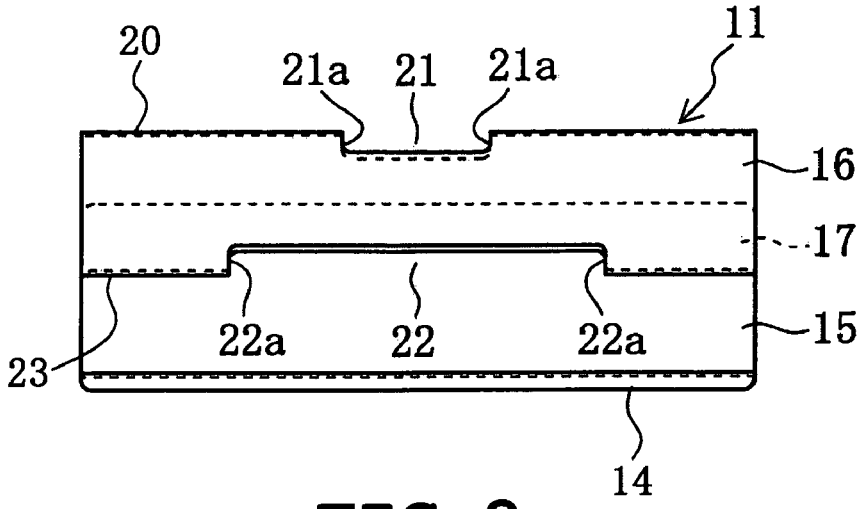
FIG. 2 is a front view of a leaf spring member.

As shown in FIG. 2, there is formed a slit 21 in a center part in a lateral direction of the bent portion 20 between the first plate portion 15 and the second plate portion 16. The slit 21 has a length corresponding to about one fourth of a width of the first plate portion 15 and the second plate portion 16. Moreover, there is formed a slit 22 in a center part in a lateral direction of the second bent portion 23 between the second plate portion 16 and the second engaging portion 17. The slit 22 has a length corresponding to about one half of the width of the second plate portion 16 and the second engaging portion 17. Both ends of these slits 21, 22 will function as positioning parts 21*a*, 22*a* for positioning the relevant spring member 12 and holding them at determined positions, in a state where the spring member 12 has been fitted to the second plate portion 16, as described below. The second engaging portion 17 formed adjacent to the second plate portion 16 is adapted to come into contact with the inclined face 19 of the outer frame 2 from inside to be engaged therewith.

Figure 4:
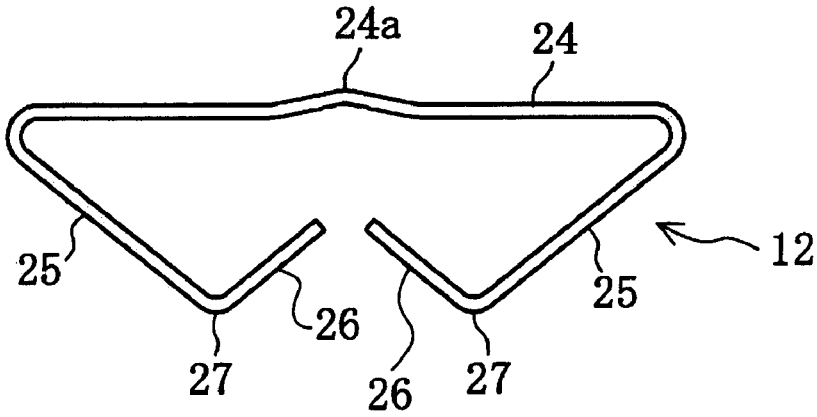
FIG. 4 is a front view of an urging member.
Figure 5:
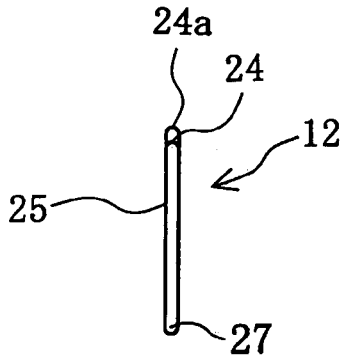
FIG. 5 is a side view of the urging member.

By the way, the above described spring member 12 is formed by bending a resilient linear member (a so-called resilient member) such as a piano wire, as shown in FIG. 4. This spring member 12 has a horizontal side 24 extending in a lateral direction of the second plate portion 16, and a pair of diagonal sides 25 which are bent downward at an angle of about 30 to 40 degrees from both ends of this horizontal side 24. The pair of these diagonal sides 25 are integrally formed with end pieces 26 which are respectively bent upward at an angle of about 90 to 110 degrees, by way of pressure portions 27. Moreover, an engaging portion 24*a* which is projected a little upwardly is formed in a center part in a lateral direction of the horizontal side 24. The spring member 12 has a shape of a straight rod in a side view, as shown in FIG. 5.

Figure 7:
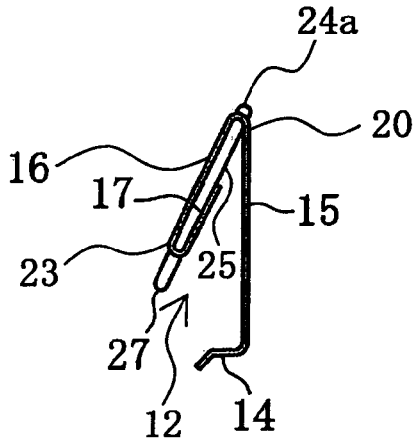
FIG. 7 is a side view of the clip for clamping the cloth.

The spring member 12 which has been formed in this manner is fitted to the leaf spring member 11, as shown in FIGS. 6 and 7. On occasion of mounting the spring member 12, the horizontal side 24 is positioned on the first bent portion 20, and the engaging portion 24*a* is engaged with the slit 21, as a first step. Then, the engaging portion 24*a* comes into contact with the positioning parts 21*a*, whereby the horizontal portion 24 is positioned and held with respect to the first bent portion 20, in the lateral direction. Further, the pair of the diagonal sides 25 of the spring member 12 are positioned on the second bent portion 23, and both the diagonal sides 25 are engaged with the slit 22. Then, the diagonal sides 25 come into contact with the positioning parts 22*a*, whereby the diagonal sides 25 are positioned and held with respect to the second bent portion 23 in the lateral direction. The clip 10 for clamping the cloth is constructed in this manner. In this case, the pressure portion 27 protrudes downwardly from the slit 22. It is to be noted that the spring member 12 is fitted to the leaf spring member 11 and held by a resilient repulsive force (resilient force) of the relevant spring member 12.

Now, operation and effects of this clip 10 for clamping the cloth will be respectively described.

As a first step, the embroidery frame 1 as shown in FIG. 1 is placed on a table (not shown) of an embroidering machine (not shown), and the cloth F to be worked (See FIG. 8) is spread and set on the inner frame 3. Then, the outer frame 2 is fitted to an outside of the inner frame 3. In this manner, the cloth F to be worked is held between the inner frame 3 and the outer frame 2, and further, the cloth F extending to the exterior of the embroidery frame 1 is pulled upwardly (in an upper direction in FIG. 8) thereby to put the cloth F to be worked into a stretched state.

In the next step, while the cloth F to be worked is held between the outer frame 2 and the inner frame 3, for example five clips for clamping the cloth are mounted on those positions where a stretching and holding force for stretching the relevant cloth F is rather weak, that is, the longer sides 2*a* and 2*b* of the outer frame 2. On this occasion, the clip 10 for clamping the cloth is initially placed on the outer frame 2 from above, as shown in FIG. 8, and the second engaging portion 17 is brought into contact with the inclined face 19 of the outer frame 2. In this state, the first engaging portion 14 is not yet engaged with the engaging recess 18 of the outer frame 2, and the first plate portion 15 is also positioned apart from the outside face of the frame 2.

When the first plate portion 15 is pushed toward the outer frame 2 from this state, the leaf spring member 11 will be resiliently deformed a little so as to expand in a vertical direction, whereby the first engaging portion 14 will be engaged with the engaging recess 18, and further, a part of the first plate portion 15 will be brought into contact with an outer face of the outer frame 2. In this manner, the clip 10 for clamping the cloth can be mounted on the outer frame 2. It is to be noted that in a state where the clip 10 for clamping the cloth has been mounted on the outer frame 2 (the embroidery frame 1), the first engaging portion 14 is in such a state as not protruding from the lower face of the outer frame 2 (in the not protruded state).

Now, operation of the spring member 12 in the state where the clip 10 for clamping the cloth has been mounted on the outer frame 2 will be described. The spring member 12 is formed of the piano wire as described above, and therefore, can be resiliently deformed in its entirety in a vertical direction, as shown by a phantom line in FIG. 6. Accordingly, in a state where the clip 10 for clamping the cloth has been mounted on the outer frame 2, the pressure portion 27 of the spring member 12 comes into contact with an outside crest of the inner frame 3, and the spring member 12 will be resiliently deformed so as to contract in a vertical direction, whereby a resilient repulsive force in a downward direction will arise. On this occasion, the cloth F to be worked extending upwardly from between the outer frame 2 and the inner frame 3 is positioned on the outside crest of the inner frame 3. Consequently, the cloth F will be held because it has been intensively pressed onto the outside crest of the inner frame 3, as shown in FIG. 8, by the pressure portion 27 having the resilient repulsive force. A direction of pressure of the pressure portion 27 of the spring member 12 is so adjusted as to be in parallel with the direction of inclination of the second plate portion 16, and at an acute angel with respect to a vertical direction.

Because the pressure portion 27 is formed by bending the piano wire, the pressure portion 27 has a very small contact area (a pressurizing area) with respect to the cloth F to be worked. Accordingly, an area pressure from the pressure portion 27 on the cloth F to be worked will be extremely high. As the results, the pressure portion 27 will reliably press the cloth F which is positioned on the longer sides 2*a* and 2*b* of the outer frame, and hence, the cloth F can be held without a slack.

As described above, in the clip 10 for clamping the cloth in this embodiment, mounting of the clip 10 on the outer frame 2 is started with the leaf spring member 11. Accordingly, the clip 10 can be easily mounted on or dismounted from the outer frame 2, while a size of the whole leaf spring member 11 is reduced.

Moreover, it is so constructed that the cloth F to be worked may be pressed onto the inner frame 3 by means of the pressure portion 27 of the spring member 12. For this reason, the spring member 12 can be resiliently deformed according to the cloth F having a variety of thickness, whereby suitable pressures can be obtained. As the results, the cloth to be worked having various thicknesses can be reliably held by using the clip 10 for clamping the cloth.

Further, it is so constructed that on occasion of mounting the clip 10 for clamping the cloth on the outer frame 2, the first plate portion 15 of the leaf spring member 11 may be brought into contact with the outer face of the outer frame 2, and at the same time, the second plate portion 16 may be brought into contact with the inclined face 19 of the outer frame 2. For this reason, the clip 10 for clamping the cloth will not protrude outwardly from an outer peripheral face of the outer frame, that is, the embroidery frame 1, and consequently, the clip 10 can be prevented from interfering with other members (for example, legs of the embroidering machine or the like, although not shown), on occasion of conducting the embroidery sewing. In this case, a moving range of the embroidery frame 1 will not be reduced, and the clip 10 for clamping the cloth will not protrude into the embroidery frame 1 (into the inner frame 3), and hence, a range of the embroidery sewing can be reliably secured. Further, similar effects to the above described can be obtained, because the first engaging portion 14 is also engaged with the engaging recess 18 of the outer frame 2, and will not protrude from the lower face of the outer frame 2.

In addition, because the leaf spring member 11 and the spring member 12 have very simple structures respectively, it is possible to make the members compact and lightweight according to necessity, or to easily adjust degree of their resilient deformation.

Although the piano wire has been employed as material for the spring member 12 in this embodiment, the invention is not limited to this, but a resilient member made of nonmetal can be employed, provided that it can be resiliently deformed.

Now, a second embodiment of the invention will be described referring to FIGS. 9 to 12. It is to be noted that substantially the same members as in the above described first embodiment will be denoted with the same reference numerals, and detailed explanation of the same will be omitted.

Figure 9:
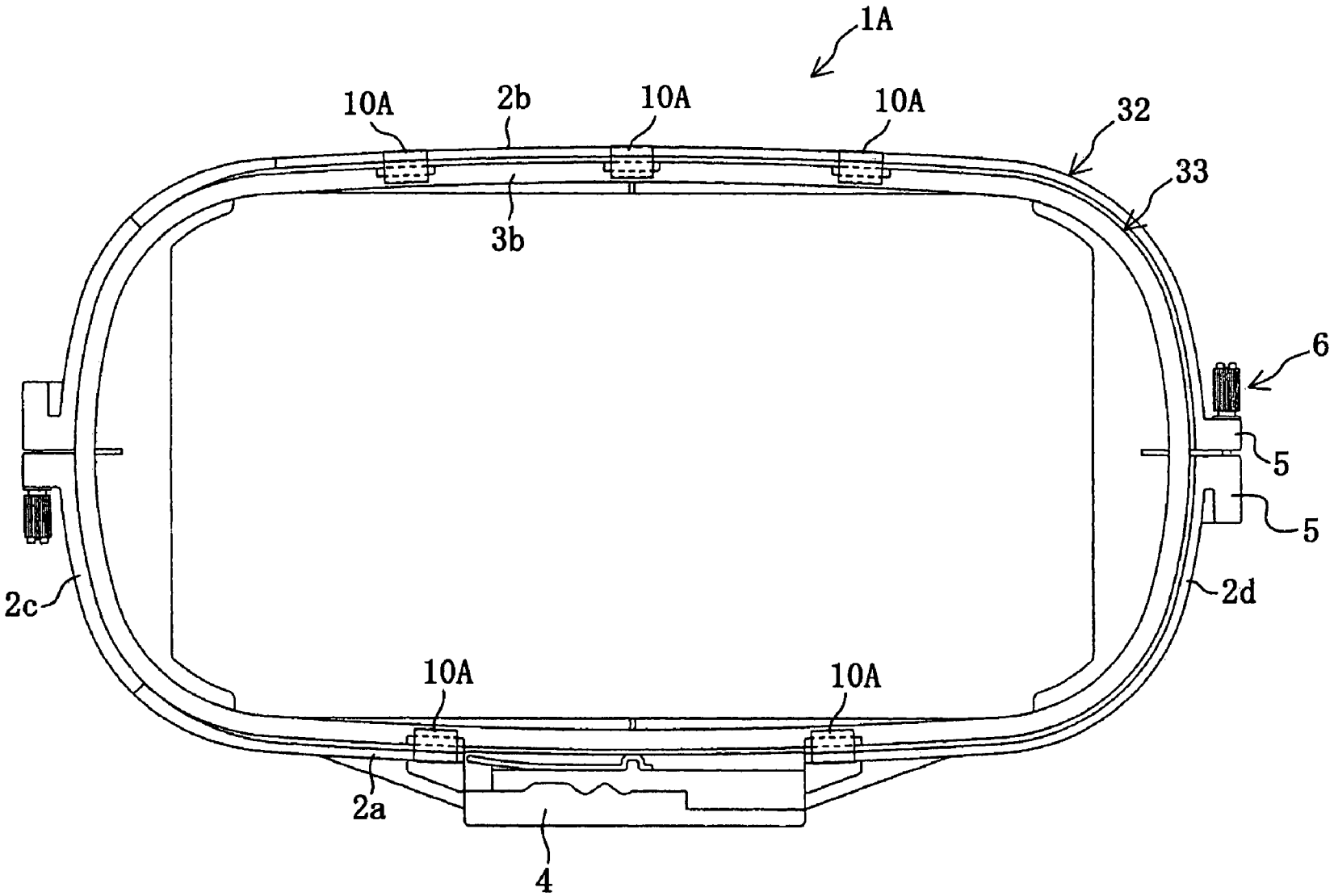
FIG. 9 is a view similar to FIG. 1 showing a second embodiment of the invention.

As shown in FIG. 9, in an embroidery frame 1A in this embodiment, three clips 10A for clamping a cloth are mounted on the side 2*b* of the outer frame and the side 3*b* of the inner frame at regular intervals, and further, two clips 10A for clamping the cloth are mounted on the side 2*a* of the outer frame and the side 3*a* of the inner frame.

Figure 12:
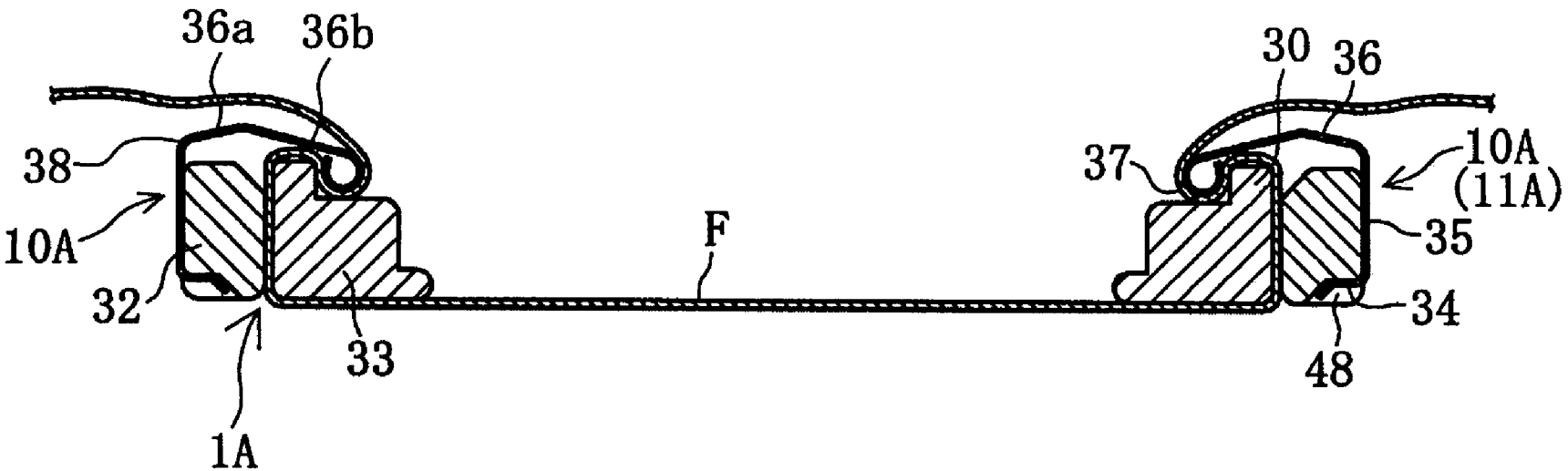
FIG. 12 is a view similar to FIG. 8.

As shown in FIG. 12, the embroidery frame 1A has a different sectional shape from the above described first embodiment. Specifically, an inner frame 33 is provided, in an upper part of its outer peripheral side, with a stepped part 30 which is made higher than an inner peripheral side thereof.

Figure 10:
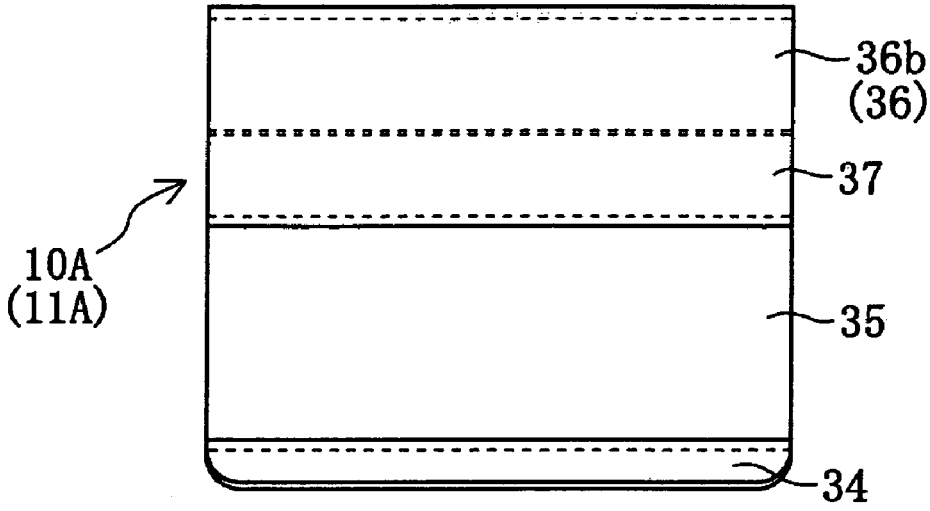
FIG. 10 is a view similar to FIG. 6.
Figure 11:
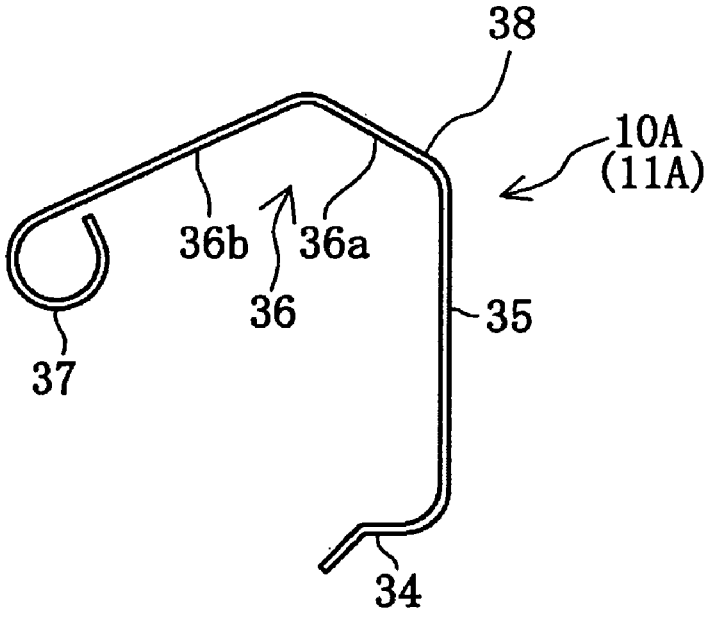
FIG. 11 is a view similar to FIG. 7.

Then, a structure of the clip 10A for clamping the cloth in this embodiment will be described referring to FIGS. 10 and 11.

The clip 10A for clamping the cloth is formed of a leaf spring member only, and so adapted to be detachably mounted on both the outer frame 32 and the inner frame 33. This clip 10A for clamping the cloth integrally has a first engaging portion 34, a first plate portion 35, a second plate portion 36, and a second engaging portion 37.

The first engaging portion 34 is designed in such a manner that it may be engaged with an engaging recess 48 in a lower part of the outer frame 32 from outside, and may not protrude from a lower face of the outer frame 32, as shown in FIG. 12. The first plate portion 35 is formed in a shape of a flat plate extending upwardly at a right angle from the first engaging portion 34 along an outside face of the outer frame 32, as shown in FIG. 11. A height of the first plate portion 35 is substantially the same as a height of the outer frame 32.

The second plate portion 36 extends toward the inner frame 33 by way of a bent portion 38 in an upper part of the first plate portion 35. As shown in FIG. 11, this second plate portion 36 has an L-shape whose corner is directed upward in a side view, and includes a first inclined portion 36*a* and a second inclined portion 36*b*. The second engaging portion 37 has a cylindrical shape in a side view, so as to protrude downwardly from a distal end of the second plate portion 36. As shown in FIG. 12, the second plate portion 36 will come into contact with the stepped part 30 of the inner frame 33 from inside to be engaged therewith, thereby to press the cloth F to be worked onto the inner frame 33.

For reference, the leaf plate member 11A corresponds to the mounting member in the claims, and the first plate portion 35 corresponds to the contact portion which is adapted to come into contact with an outer peripheral face of the outer frame 32, so as to be substantially in flush with the outer peripheral face of the outer frame 32.

Now, operation and effects of this clip 10A for clamping the cloth will be respectively described.

As shown in FIG. 12, after the cloth F to be worked has been held between the inner frame 33 and the outer frame 32, the clip 10A for clamping the cloth is mounted from outside so as to grasp the lower part of the outer frame 32 and the upper part of the inner frame 33. On this occasion, the first engaging portion 34 is engaged with the engaging recess 48 of the outer frame 32, in such a manner that it may not protrude from the lower face of the outer frame 32. Further, the clip 10A for clamping the cloth in this state is expanded in a vertical direction so as to be resiliently deformed a little, whereby the second engaging portion 37 is engaged with the stepped part 30 of the inner frame 33 from diagonally upward position inside the inner frame 33. Then, a downward force will be applied to the second engaging portion 37 by the resilient repulsive force of the leaf spring member 11A.

On this occasion, the cloth F to be worked extending upwardly is held between the inner frame 33 and the outer frame 32, as shown in FIG. 12, and accordingly, the cloth F will be pressed onto the stepped part 30 of the inner frame 33 by the second engaging portion 37 to be secured there.

According to the clip 10A for clamping the cloth having the above described structure, substantially the same effects as in the above described first embodiment can be obtained. At the same time, because an extremely simple structure can be achieved, it is possible to enhance cost efficiency.

Figure 14:
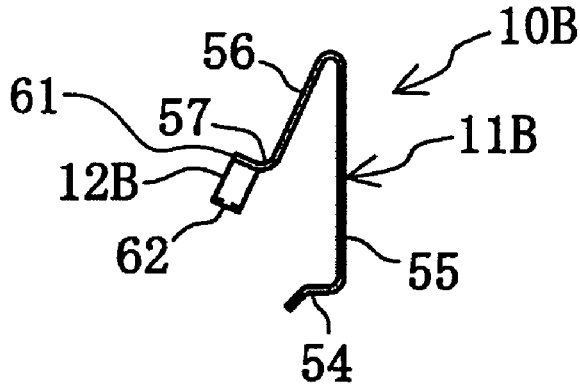
FIG. 14 is a view similar to FIG. 7.
Figure 15:
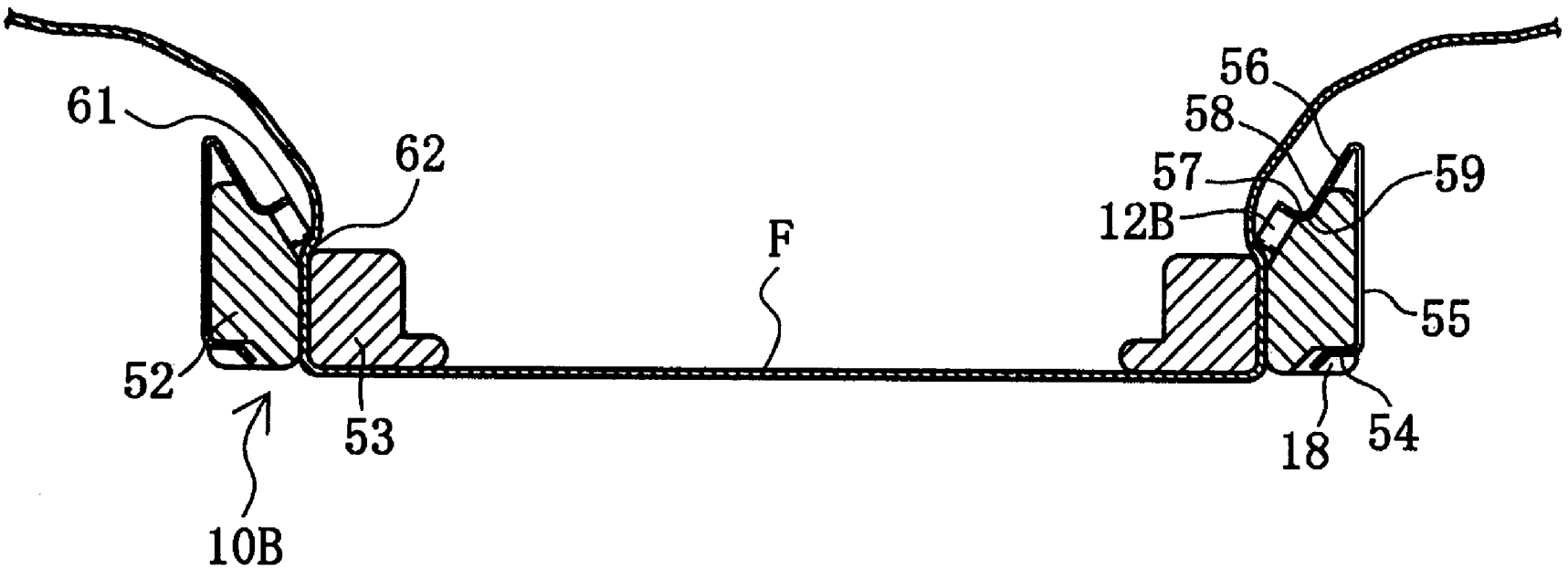
FIG. 15 is a view similar to FIG. 8.

Now, a third embodiment of the invention will be described referring to FIGS. 13 to 15. It is to be noted that substantially the same members as in the above described first embodiment will be denoted with the same reference numerals, and detailed explanation of the same will be omitted.

Figure 13:
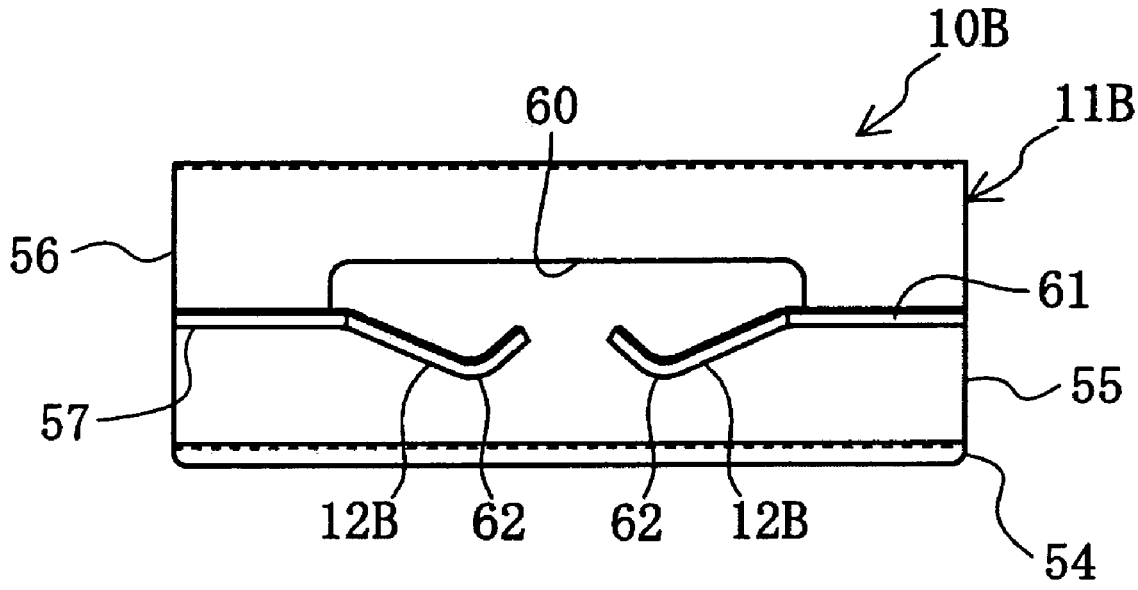
FIG. 13 is a view similar to FIG. 6 showing a third embodiment of the invention.

As shown in FIG. 13, a clip 10B for clamping a cloth in this embodiment includes a leaf spring member 11B and a pair of spring members 12B integrally formed. This clip 10B for clamping the cloth integrally has a first engaging portion 54, a first plate portion 55, a second plate portion 56, and a spring member 12B which is connected to this second plate portion 56 by way of a second engaging portion 57.

An outer frame 52 is provided, in its upper part, with an inclined face 58 which is inwardly inclined, and a stepped part 59 is formed on this inclined face 58. The aforesaid second plate portion 56 is formed so as to extend in parallel with the aforesaid inclined face 58 from an upper part of the first plate portion 55 up to the stepped part 59 of the inclined face 58. Further, the second engaging portion 57 of the second plate portion 56 is adapted to be engaged with the aforesaid stepped part 59.

The second plate portion 56 is provided with an opening 60 in its lower part, as shown in FIG. 13. Located at both ends of this opening 60 and in the lower part of the second plate portion 56, there are formed flanges 61 which are projected from the second plate portion 56, as shown in FIG. 14. The spring member 12B is formed having the same width as these flanges.

Each of the spring members 12B has an L-shape whose corner is directed downward in a front view, as shown in FIG. 13, and is so formed as to be resiliently deformed in a vertical direction. Moreover, the spring member 12B is provided with a pressure portion 62 for pressing the cloth F to be worked onto a crest of an inner frame 53.

For reference, the aforesaid clip 10B corresponds to the mounting member in the claims, and the spring member 12B corresponds to the pressure member. According to the clip B for clamping the cloth having the above described structure, substantially the same effects as in the above described first and second embodiments can be obtained.

In this embodiment, the opening 60 is not always necessary, but it may be formed according to purpose.

Now, a fourth embodiment of the invention will be described referring to FIGS. 16 and 17. It is to be noted that substantially the same members as in the above described first embodiment will be denoted with the same reference numerals, and detailed explanation of the same will be omitted.

Figure 16:
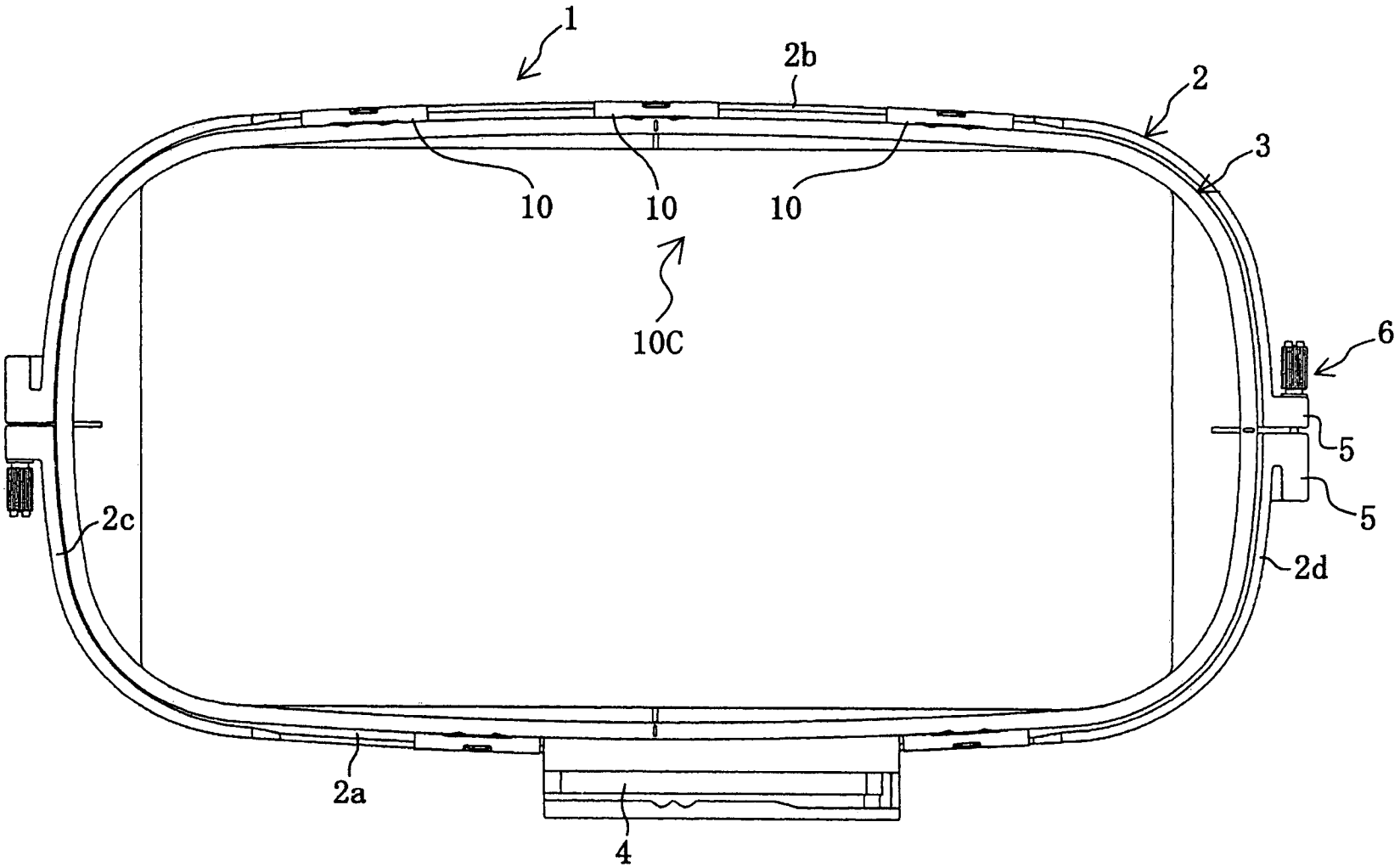
FIG. 16 is a view similar to FIG. 1 showing a fourth embodiment of the invention.
Figure 17:
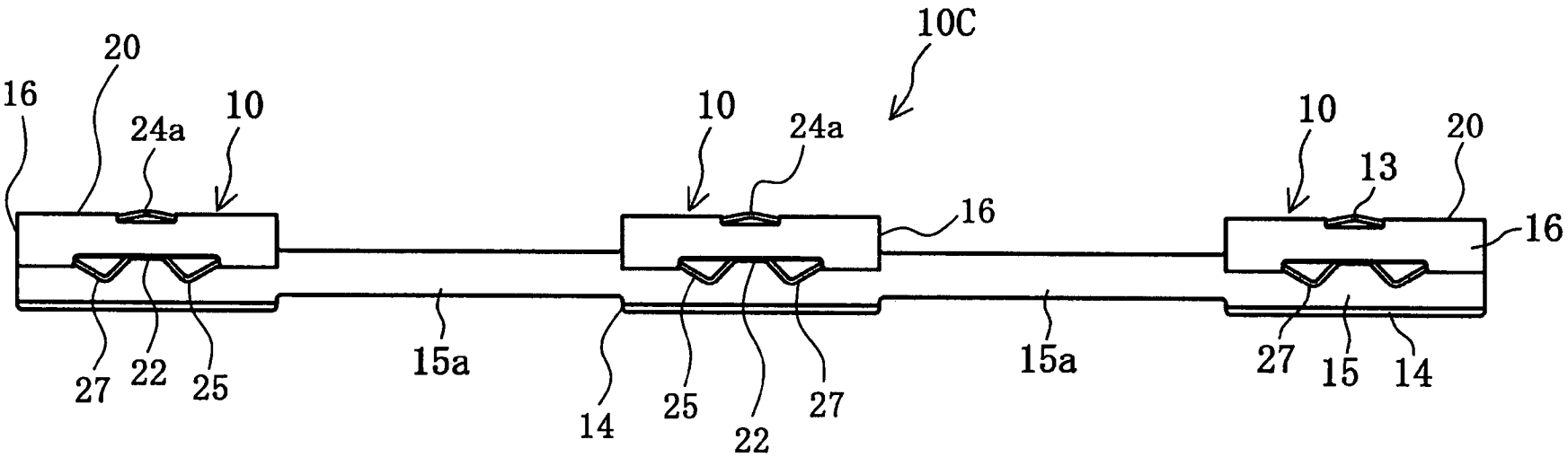
FIG. 17 is a view similar to FIG. 6.

As shown in FIG. 16, a clip 10C for clamping a long-length cloth is mounted on the side 2*b* of the outer frame of the embroidery frame 1, and the two clips 10 for clamping the cloth are mounted on the side 2*a* of the outer frame. Moreover, as shown in FIG. 17, the clip 10C for clamping the long-length cloth has a long length in a lateral direction. The clip 10C for clamping the long-length cloth has such a structure that the first plate portions 15 of the three clips 10 for clamping the cloth are connected in a lateral direction by way of connecting plate portions 15*a*.

According to the above described structure, not only substantially the same effects as in the above described first embodiment can be obtained, but also, the clip 10C for clamping the long-length cloth becomes hard to be detached, because an area of the first plate portion 15 to come into contact with the outer face of the outer frame 2 will be increased (in other words, the connecting plate portion 15*a* too is brought into contact with the outer face).

Moreover, because necessity of employing a plurality of the clips 10 for clamping the cloth will be eliminated, mounting or dismounting the clips can be easily conducted.

Although the clip 10C for clamping the long-length cloth in this embodiment is constructed by connecting the three clips 10 for clamping the cloth, the invention is not limited to this structure, but can be appropriately modified according to a size of the embroidery frame 1 or a thickness of the cloth F to be worked. Further, the clips 10A and 10B for clamping the cloth in the second and the third embodiments may be also connected to form the clip 10C for clamping the long-length cloth.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A clip for clamping a cloth to be mounted on an embroidery frame including an outer frame, and an inner frame which is internally engaged with the outer frame thereby to hold a cloth to be worked between the outer frame and the inner frame, the clip comprising;

a leaf spring member which can be detachably mounted on the outer frame, and an urging member that is separate and distinct from the leaf spring member and adapted to press the cloth to be worked onto the inner frame, wherein the leaf spring member includes:

a first engaging portion adapted to be engaged with a lower part of the outer frame from outside, a first plate portion extending upwardly from the first engaging portion, a second plate portion formed in an upper part of the first plate portion by way of a bent portion and downwardly inclined along an inner face of the outer frame, and a second engaging portion formed in the second plate portion and adapted to be engaged with an upper part of the outer frame from inside, the urging member being provided on the second plate portion and adapted to press a part of the cloth to be worked that extends upwardly from between the outer frame and the inner frame onto the inner frame.

2. The clip for clamping a cloth as claimed in claim 1, wherein a direction of pressure of the urging member is in parallel with a direction of inclination of the second plate portion, and at an acute angle with respect to a vertical direction.

3. The clip for clamping a cloth as claimed in claim 2, wherein the cloth to be worked is pressed with the urging member onto an outside crest of the inner frame.

4. The clip for clamping a cloth as claimed in claim 1, wherein an inner face of the outer frame is formed as an inclined face which is inclined inwardly, a part of the first plate portion of the leaf spring member is so designed as to come into contact with an outer face of the outer frame, and a part of the second plate portion is so designed as to come into contact with the inclined face of the outer frame.

5. The clip for clamping a cloth as claimed in claim 1, wherein the outer frame is provided with an engaging recess in a lower part thereof, and the first engaging portion is engaged with the engaging recess so as not to protrude from a lower end face of the outer frame.

6. The clip for clamping a cloth as claimed in claim 1, wherein the urging member is a spring member which is formed by bending resilient linear material.

7. The clip for clamping a cloth as claimed in claim 6, wherein the spring member has a pressure portion which is projected from the second plate portion thereby to press the cloth to be worked onto the inner frame.

8. The clip for clamping a cloth as claimed in claim 7, wherein the leaf spring member is formed with a positioning part for positioning the spring member.

9. A clip for clamping a cloth to be mounted on an embroidery frame including an outer frame, and an inner frame which is internally engaged with the outer frame thereby to hold a cloth to be worked between the outer frame and the inner frame, the clip comprising:

a mounting member which is detachably mounted on the outer frame, and a pressure member that is separate and distinct from the mounting member and adapted to press an outside crest of the inner frame.

10. The clip for clamping a cloth as claimed in claim 9, wherein the mounting member has a contact portion which comes into contact with an outer peripheral face of the outer frame so as to be substantially in flush with the outer peripheral face, in a state mounted on the outer frame.

11. The clip for clamping a cloth as claimed in claim 9, wherein the mounting member has an engaging portion which is engaged with a lower face of the outer frame so as to be substantially in flush with the lower face, in a state mounted on the outer frame.

12. The clip for clamping a cloth as claimed in claim 9, wherein the mounting member is formed of a resilient member which can be resiliently deformed.

13. The clip for clamping a cloth as claimed in claim 12, wherein the resilient member is a leaf spring member.

14. The clip for clamping a cloth as claimed in claim 9, wherein at least one of the mounting member and the pressure member is provided with a positioning part for positioning the pressure member when the pressure member is fitted to the mounting member.

15. The clip for clamping a cloth as claimed in claim 9, wherein the pressure member is a resilient member which can be resiliently deformed.

16. The clip for clamping a cloth as claimed in claim 15, wherein the resilient member is fitted to the mounting member and held by resiliency of the resilient member itself.

17. The clip for clamping a cloth as claimed in claim 15, wherein the resilient member is formed of resilient linear material.

* * * * *